US006806957B2

(12) United States Patent
Van Wersch

(10) Patent No.: US 6,806,957 B2
(45) Date of Patent: Oct. 19, 2004

(54) METHOD FOR PLAIN DYEING A TEXTILE WEB OF FABRIC

(75) Inventor: Kurt Van Wersch, Wegberg (DE)

(73) Assignee: Monforts Textilmaschinen GmbH & Co., Mönchengladbach (DE)

( * ) Notice: Subject to any disclaimer, the term of this patent is extended or adjusted under 35 U.S.C. 154(b) by 0 days.

(21) Appl. No.: 10/239,809

(22) PCT Filed: Mar. 2, 2001

(86) PCT No.: PCT/DE01/00840

§ 371 (c)(1),
(2), (4) Date: Sep. 25, 2002

(87) PCT Pub. No.: WO01/73181

PCT Pub. Date: Oct. 4, 2001

(65) Prior Publication Data

US 2003/0052285 A1 Mar. 20, 2003

(30) Foreign Application Priority Data

Mar. 25, 2000 (DE) ..... 100 14 965

(51) Int. Cl.[7] ..... D06B 23/26; G01J 3/50

(52) U.S. Cl. ..... 356/402; 356/405; 356/407; 8/151; 8/400

(58) Field of Search ..... 356/402, 405, 356/406, 407; 250/226; 8/151, 400

(56) References Cited

U.S. PATENT DOCUMENTS 4,869,188 A * 9/1989 Hyodo ..... 112/445
5,050,258 A * 9/1991 Fischer et al. ..... 8/151

FOREIGN PATENT DOCUMENTS

| | | |
|---|---|---|
| DE | 42 38 234 | 5/1994 |
| DE | 44 31 637 | 10/1995 |
| EP | 0 411 414 | 6/1993 |

* cited by examiner

*Primary Examiner*—F. L. Evans
(74) *Attorney, Agent, or Firm*—Collard & Roe, P.C.

(57) ABSTRACT

The invention relates to a method for plain dyeing a textile web of fabric by means of a padding mangle. The squeezing force distribution between the rollers of the padding mangles is controlled according to the dye distribution in the web of fabric which is still provided with the initial humidity on the output of the padding mangle, whereby the dye distribution is measured on certain points by means of a dye measuring appliance. Measuring the dye of the humid web of fabric is simplified and the measured result is improved when a dye receiver is used as the dye measuring device, whereby the receiver separately detects the radiation of a white light source according to pure dyes, the radiation being reflected on the web of fabric in a diffuse manner.

4 Claims, No Drawings

METHOD FOR PLAIN DYEING A TEXTILE WEB OF FABRIC

CROSS REFERENCE TO RELATED APPLICATIONS

Applicant claims priority under 35 U.S.C. §119 of German Application No. 100 14 965.0 filed Mar. 25, 2000. Applicant also claims priority under 35 U.S.C. §365 of PCT/DE01/00840 filed Mar. 2, 2001. The international application under PCT article 21(2) was not published in English.

The invention relates to a method for single color dyeing a textile web of fabric by means of a padding machine with a web squeezer. The squeezing force distribution between the rollers of the padding machine is controlled according to the dye distribution in the web of fabric that is still provided with the initial humidity on the output of the padding machine. The dye distribution is measured on certain points by means of a dye measuring appliance.

A method of this type is described in EP 0 411 414 B 1. Through the known dye measurement of the web of fabric, which is still damp, possible deviations of the dye distribution from the target value can be detected practically immediately after leaving the padding machine. Hence only a few meters of web of fabric are needed to regulate the squeezing force distribution of the rollers of the padding machine necessary for the predetermined dye distribution. Readjustment may be permanently made when operating such an installation.

The dye measuring instruments for the implementation of the known method are however, when put into practice, so costly that as a rule only one dye measuring instrument is available for the whole width of a web of fabric, for example 3 meters. The instrument must therefore be moved back and forth on rails laterally to the direction that the web is moving. For cost reasons many users do not employ the environmentally friendly method at all. Added to this is also the disadvantage that when employing the known method, the dye measuring instruments used could only measure the total dye impression.

With regard to dye measuring, it is also known from EP 0 411 414 B1 and DE 42 38 234 A 1 that in addition to a brightness measurement in the visible area, a dampness measurement should also be taken on a textile web and both measuring signals should be used to control the squeezing force distribution of the padding machine squeezers. In the known method two brightness sensors (one for visible, one for infrared light) are even needed at every measuring point. Nevertheless, the instruments can only detect the total brightness impression in each measurement area. When single-color dyeing, pure dyes are practically never used. Mixed dyes are almost always used instead. A dye applied to a web of fabric in a padding machine contains therefore a mixture of dye particles of varying dyeing effect, e.g. red, yellow, and black dye particles in the predetermined mixing ratio.

The invention is based on the task of making available a less costly dye measuring instrument for the method of the type mentioned at the beginning. With this dye measuring instrument the concentration of the dye particles (e.g. dye-forming particles) contained in the dye employed can be measured.

For the method of single-color dyeing, for which by means of a dye measuring instrument the dye distribution in the web of fabric that is still damp is measured at certain points, the solution in accordance with the invention is that the dye receiver is used as a measuring instrument, whereby the receiver separately detects the radiation of a light source, preferably a white-light source, according to pure dyes, with the radiation being reflected onto the fabric in a diffuse manner. Preferably within the framework of the invention, a dye receiver is used that can detect individual frequencies, e.g. for the red, green and blue portions, of the reflected radiation. A few improvements and further embodiments of the invention are indicated in the subclaims.

A dye receiver, or color receiver, of the type to be used is commercially available. It is used, for example, for sorting coffee beans according to the color or degree of roasting or for the sorting of mass-produced plastic parts according to color. The device served in practice heretofore to differentiate variously colored pieces from each other and to sort according to color. Thus it is surprising that this device is also to be employed for monitoring a single-color dyed web of fabric, a use that for the original concept is atypical.

Particularly unexpected is the invention's success when applied to a dyed, but still damp, web of fabric. As is generally known, a damp web of fabric looks different colored than the same web of fabric when it is dry. In addition, the dye that appears later on the dry web of fabric is often only developed during drying and setting (e.g. chemically) following the immersion and squeezing in the padding machine.

This success is based on the realization of the inventor that it is advantageous for the dye measurement of the web of still damp fabric to measure the concentration of dye particles of every individual dye—dye for dye. With single color-dyeing the concentration should be made the same everywhere. It is this that matters in the invention. Less important in the framework of this process is, on the other hand, the adjusting of a certain shade of color. It can also already suffice to measure the concentration of particles of a single pure dye on several points lateral to the direction of movement of the web of fabric and to control the rollers of the padding machine in such a way that the concentration at all measuring points is the same. This simplification in accordance with the invention requires that—as is fundamentally to be assumed—the dye bath used in the padding machine dye vat is homogeneously mixed.

The measuring instrument used in accordance with the invention can be produced relatively small and economically. Several devices can therefore be positioned at each measuring line laterally to the direction of movement of the web of fabric. In some cases a special shifting mechanism, which was necessary for cost reasons according to the level of technology of dyeing of web of fabric mentioned at the beginning, is then saved.

Preferably a white light LED, especially with an adjustable transmitting power, is used as a white light source. The transmitting power should be adjustable within the framework of the method according to the invention in order to keep the power of each measuring signal detected within a predetermined measuring or display range. For example, for bright dyes (with greater reflective capability) a smaller transmitting power is needed than for dark dyes (with lower reflection capability of the web of fabric), if the measuring signal should fall in both cases in approximately the same power range.

What is claimed is:

1. Method for the single color-dyeing of a textile web of fabric by means of a coloring padding machine with an appertaining roller squeezer, comprising controlling the squeezing force distribution between the rollers of the padding machine in dependence on the dye distribution in the web of fabric, which still contains the initial dampness at the output of the padding machine, measuring the dye distribution at points by means of a color measuring instrument, and using a color receiver as dye measuring device, which receives the radiation of a light source diffusely reflected on the web of fabric, separated in pure colors; and wherein only the concentration of dye particles of a single pure color is used for the control of the squeezing force distribution for a mixed dye applied to the web of fabric.

2. Method according to claim 1, wherein a color receiver is used that separately receives the reflected radiation of a white light source, especially for the red, green and blue portion of the reflected radiation.

3. Method according to claim 1, wherein a white light LED, is used as a light source.

4. Method according to claim 3, wherein said white light LED, has an adjustable transmitting power, and is used as a light source.

* * * * *